US005332141A

United States Patent [19]

Mukoyama et al.

[11] Patent Number: 5,332,141

[45] Date of Patent: Jul. 26, 1994

[54] NAILING MACHINE

[75] Inventors: Kenji Mukoyama; Nobuyuki Kakuda, both of Anjo, Japan

[73] Assignee: Makita Corporation, Anjo, Japan

[21] Appl. No.: 131,606

[22] Filed: Oct. 5, 1993

[30] Foreign Application Priority Data

Oct. 7, 1992 [JP] Japan ..... 4-296378

[51] Int. Cl.[5] ..... B25C 1/04

[52] U.S. Cl. ..... 227/136

[58] Field of Search ..... 227/130, 136, 109

[56] References Cited

U.S. PATENT DOCUMENTS

| | | | |
|---|---|---|---|
| 3,708,097 | 1/1973 | Fisher | 227/136 |
| 3,945,551 | 3/1976 | Sato et al. . | |
| 4,257,548 | 3/1981 | Stubbings | 227/136 |
| 4,442,965 | 4/1984 | Leistner | 227/130 |
| 4,942,996 | 7/1990 | Wolfberg et al. . | |
| 5,135,152 | 8/1992 | Uno et al. . | |
| 5,240,161 | 8/1993 | Kaneko | 227/136 |

*Primary Examiner*—Scott Smith

*Attorney, Agent, or Firm*—Dennison, Meserole, Pollack & Scheiner

[57] ABSTRACT

A nailing machine includes a nail feeding channel member having therein a nail feeding channel connected to a nail guide channel formed in a driver guide. A driver is reciprocally driven through the nail guide channel for driving nails of a nail-carrying strip supplied by a nail feeding mechanism from a magazine through the nail feeding channel. A door member is mounted on the nail feeding channel member for closing and opening the nail feeding channel. An engaging pawl and a strip-retaining pawl are mounted on the door member. The engaging pawl is operable to engage one of engaging holes of the nail-carrying strip set in the nail feeding channel, as the door member is closed, for preventing movement of the nail-carrying strip in a direction opposite to the feeding direction of the nail-carrying strip. The strip-retaining pawl is operable to abut on the nail-carrying strip prior to engagement of the engaging pawl with the one engaging hole, as the door member is closed, for preventing floating of the nail-carrying strip.

6 Claims, 5 Drawing Sheets

NAILING MACHINE

BACKGROUND OF THE INVENTION

1. Field of the Invention

The present invention relates to a nailing machine for driving nails carried in series on a strip which is supplied from a magazine.

2. Description of the Prior Art

A conventional nailing machine includes a body, a driver guide having a nail guide channel therewithin, a nail feeding channel member having a nail feeding channel for supplying nails attached in series to a strip from a magazine to the nail guide channel, a nail feeding mechanism for feeding the nails attached to the strip to the nail guide channel one after another, and a door mounted on nail feeding channel member for opening and closing the nail feeding channel. An engaging pawl is mounted on the door and is operable to engage the engaging holes formed on the strip for preventing movement of the strip in an opposite direction to a feeding direction when the door is closed after setting of the strip to the nail feeding channel.

With such a conventional nailing machine, since the strip tends to be crooked and floated when the strip is set in the nail feeding channel, the engaging pawl may not engage the engaging hole of the strip but may merely about on the strip when an operator moves the door to close the same. Therefore, the door becomes difficult to be closed. If the operator forces to close the door, the engaging pawl may engage the engaging hole which is not appropriate to be engaged. More specifically, although the engaging pawl is determined to normally engage the second one of the engaging holes from the leading portion, the engaging pawl may engage the third engaging hole, resulting in that two nails are fed into the nail guide channel and that the nails are jammed within the nail guide channel.

SUMMARY OF THE INVENTION

It is, accordingly, an object of the present invention to provide a nailing machine which is operable to prevent a nail-carrying strip from crooking and floating when a door of a nail feeding channel member is closed.

It is another object of the present invention %o provide a nailing machine which may prevent a nail-carrying strip from being inappropriate set and may prevent nails from being jammed within a nail guide channel.

According to the present invention, there is provided a nailing machine comprising:

a body;

a driver guide mounted on the body and having therein a nail guide channel through which a driver for driving nails is reciprocally driven;

a nail feeding channel member having therein a nail feeding channel connected to the nail guide channel for feeding a nail-carrying strip stored in a magazine to the nail guide channel, the nail-carrying strip including a strip and a plurality of nails carried thereon by a predetermined pitch, the strip having a plurality engaging holes spaced from each other by the same pitch as the nails;

a nail feeding mechanism for feeding the nail-carrying strip into the nail guide channel;

a door member mounted on the nail feeding channel member for closing and opening the nail feeding channel; and an engaging pawl and a strip-retaining pawl mounted on the door member:

the engaging pawl being operable to engage one of the engaging holes of the nail-carrying strip set in the nail feeding channel, as the door member is closed, for preventing movement of the nail-carrying strip in a direction opposite to the feeding direction of the nail-carrying strip; and the strip-retaining pawl being operable to abut on the nail-carrying strip prior to engagement of the engaging pawl with the one engaging hole, as the door member is closed, for preventing floating of the nail-carrying strip.

The invention will become more fully apparent from the claims and the description as it proceeds in connection with the drawings.

DETAILED DESCRIPTION OF THE PREFERRED EMBODIMENT

Figure 1:
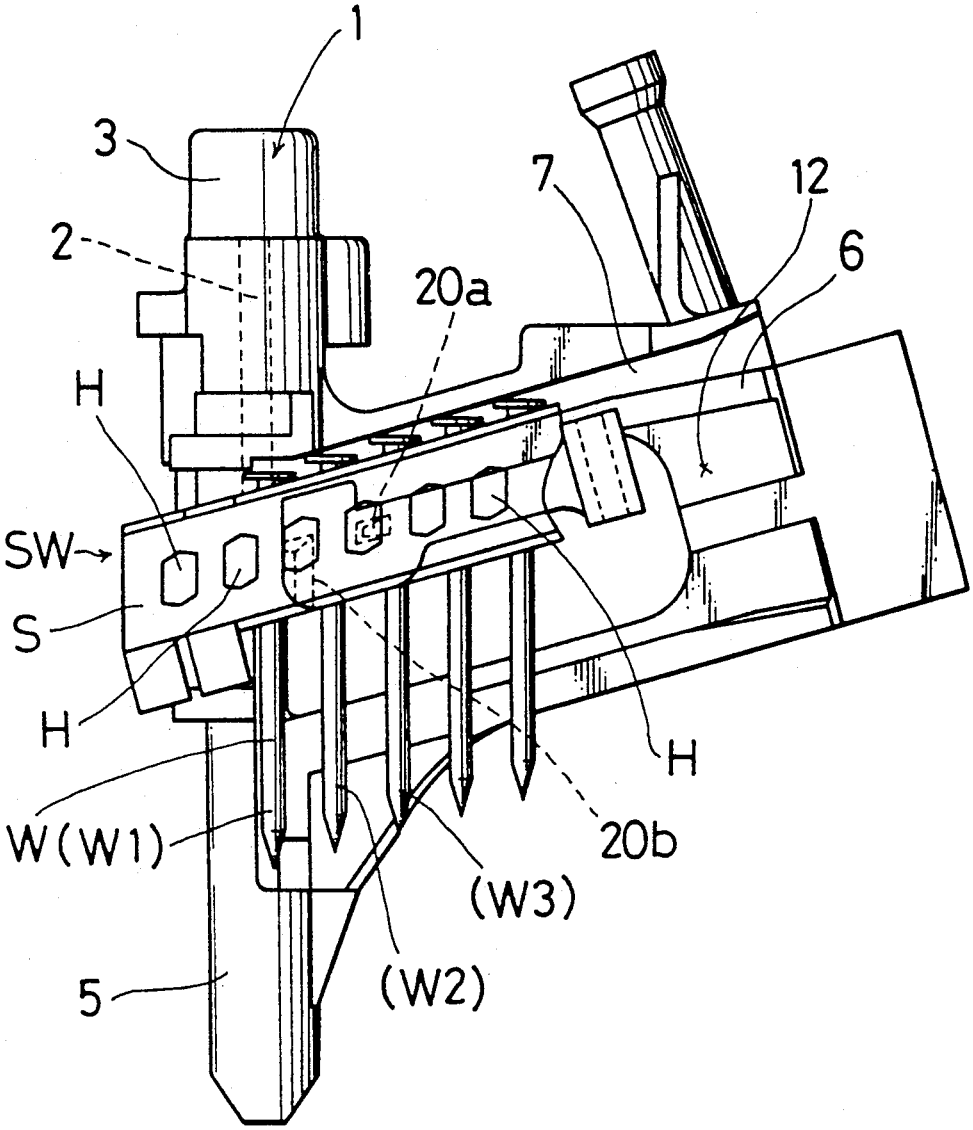
FIG. 1 is a side view of the essential parts of a nailing machine according to an embodiment of the present invention.
Figure 2:
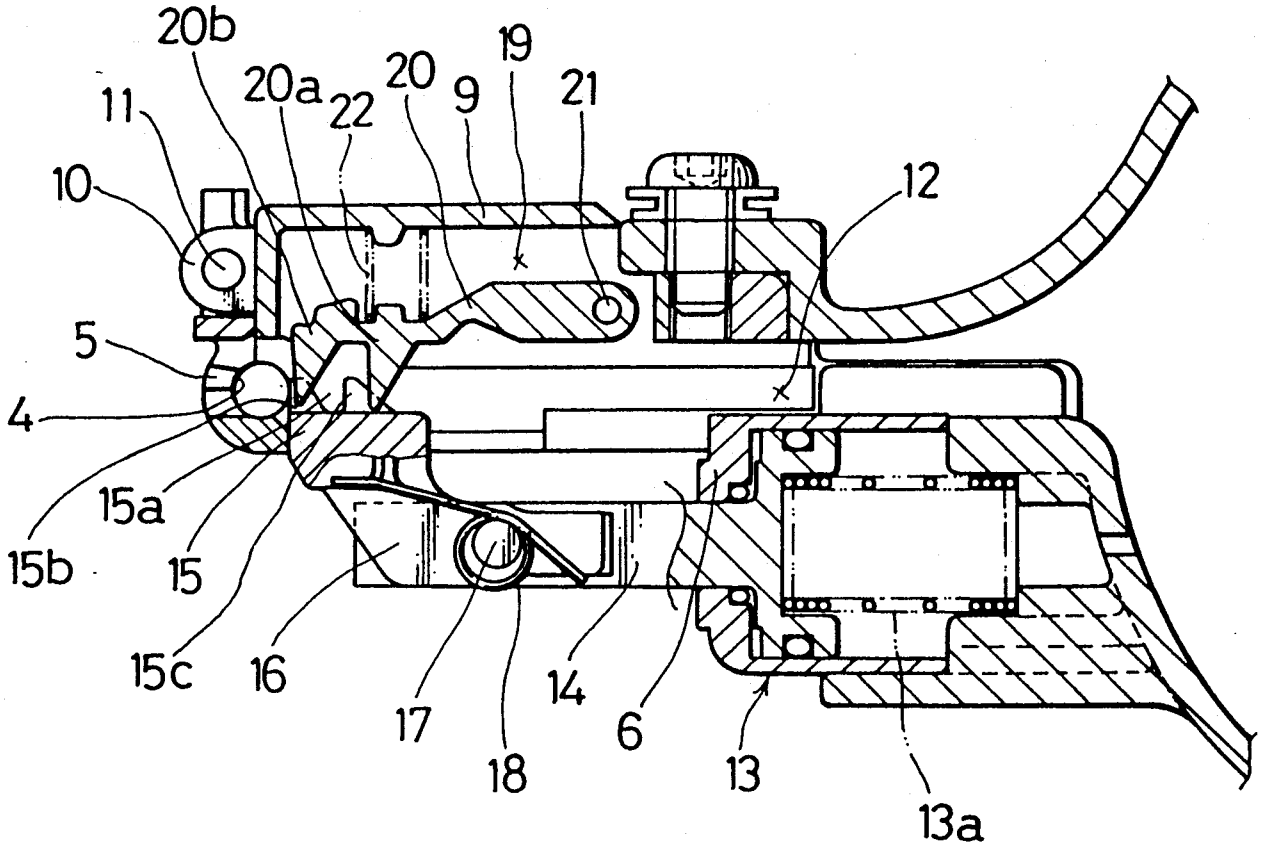
FIG. 2 is a horizontal sectional view of FIG. 1.

An embodiment of the present invention will now be explained with reference to the drawings. Referring to FIG. 1, there is shown the essential parts of a nailing machine 1. FIG. 1 shows the state where a nail-carrying strip SW is set in the nailing machine 1. The nail-carrying strip SW includes a thin strip S and nails W carried on the strip S.

The nailing machine 1 includes a nail driver 2 connected to a piston (not shown) which is disposed within a body 3 and is reciprocally driven by control of compressed air, so that the nails W are driven by the nail driver 2 one by one.

A driver guide 5 is formed integrally with the body 3 and extends downwardly therefrom. A nail guide channel through which the drive 2 is moved is formed in the driver guide. The nail-carrying strip SW is supplied from a magazine (not shown) to the nail guide channel 4 such that the nails W are fed into the nail guide channel 4 one after another. A nail feeding channel member 6 extends rearwardly from the driver guide 5. The magazine is attached to the rear end of the nail feeding channel member 6.

The nail feeding channel member 6 includes a guide recess 7 which serves to guide heads of the nails W. A door member 9 for closing and opening a nail feeding channel 12 is pivotaly mounted on a bracket 10 through a support shaft 11. The bracket 10 is mounted on the driver guide 5 and extends along the driver guide 5. The door member 9 is spaced from the nail feeding channel member 6 by a predetermined distance at its closed position. The forward end of the nail feeding channel 12 is connected to the nail guide channel 4 of the driver guide 5, while the rear end of the nail feeding channel 12 receives the nail-carrying strip SW supplied from the magazine.

The nail feeding channel member 6 includes an air cylinder 13 disposed on the outer lateral side thereof. A piston rod 14 is slidably inserted into the air cylinder 13 and extends forwardly from the air cylinder 13 along the nail feeding channel member 6. A compression spring 13*a* is disposed within the air cylinder 13 for normally biasing the piston rod 14 forwardly. A nail feeding member 15 has an arm 16 horizontally pivotaly mounted on a front end of the piston rod 14 through a support pin 17. The nail feeding member 15 includes first and second pawls 15*b* and 15*c* which protrude into the nail feeding channel 12 and form a recess 15*b* therebetween for catching one of the nails W of the nail-carrying strip SW. One surface of the first pawl 15*b* on the side of the recess 15*a* as well as one surface of the second pawl 15*c* on the side opposite to the recess 15*a* is inclined relative to the direction perpendicular to the feeding direction of the nail-carrying strip SW so as to easily catch the nail W. The other surface of the second pawl 15*c*, on which the nail W abuts when it is fed, extends perpendicular to the feeding direction.

A spiral spring 18 is wound around the support pin 17 for normally biasing the nail feeding member 15 such that the first and second pawls 15*b* and 15*c* are forced to project into the nail feeding channel 12.

After a first nail W1 fed into the nail guide channel 4 has been driven out through operation of a trigger (not shown), the nail feeding member 15 catches a third nail W3 by the recess 15*a*, and thereafter moves the third nail W3 forwardly by one pitch (one stroke of the piston rod 14) with the third nail W3 abutted on the surface of the pawl 15*c* perpendicular to the feeding direction. Such movement is produced by the biasing force of the compression spring 13*a* when the air within the air cylinder 13 on the side of the piston rod 14 or the front side is exhausted to the outside. A second nail W2 is thus fed into the nail guide channel 4.

The door member 9 includes a recess 19 formed on the side of the nail feeding channel 12. A nail lock member 20 is disposed within the recess 19 and is horizontally pivotaly supported by the door member 9 through a support shaft 21. The nail lock member 20 includes an engaging pawl 20*a* and a strip-retaining pawl 20*b*. The engaging pawl 20*a* serves to engage one of engaging holes H positioned just after the second nail W2 so as to prevent the nail-carrying strip SW from being moved rearwardly when the door member 9 is closed after setting of the nail-carrying strip SW in the nail feeding channel 12. Here, the holes H are formed in series on the nail-carrying strip SW by the same pitch as the nails W. The strip-retaining pawl 20*b* serves to abut on the strip S of the nail-carrying strip SW so as to prevent floating of the strip S when the engaging pawl 20*a* is engaged with the second nail W2.

The strip-retaining pawl 20*b* is positioned forwardly of the engaging pawl 20*a* toward the driver guide 5 and has a width longer than that of the engaging pawl 20*a* so as not to engage the engaging holes H.

One surface of the engaging pawl 20*a* as well as one surface of the strip-retaining pawl 20*b* positioned on the side of the driver guide 5 extends perpendicular to the feeding direction, while the other surfaces of the engaging pawl 20*a* and the strip-retaining pawl 20*b* are inclined relative to the direction perpendicular to the feeding direction.

A compression spring 22 is interposed between substantially the middle portion of the engaging pawl member 20 and the bottom surface of the recess 19, so that the engaging pawl member 20 is normally biased toward the nail feeding channel 12.

The operation of the above nailing machine 1 will now be explained.

As the piston for movement of the driver 2 is reciprocally moved through control of the compressed air supplied from the outside so as to reciprocally move the driver 2 within the nail guide channel 4, the nails W of the nail-carrying strip SW set in the nail feeding channel 12 are fed into the nail guide channel 4 one after another by the nail feeding member 15.

More specifically, the first nail W1 previously fed into the nail guide channel 4 is driven by the driver 2 through operation of the trigger by the operator. After the trigger returns to its original position, the second nail W2 caught by the recess 15*a* is subsequently fed into the nail guide channel 4 as the piston rod 14 is moved rearwardly at first and then moved forwardly by the distance corresponding to one pitch of the nails W, so that the second nail W2 can be driven by the driver 2. At this stage the third nail W3 is caught by the recess 15*a* for feeding after driving of the second nail W2.

The operation of the nailing machine 1 when the door 9 is closed after setting of the nail-carrying strip SW into the nail feeding channel 12 will now be explained with reference to FIGS. 3 to 7 which successively show the operation varying as the door member 9 is closed.

Figure 3:
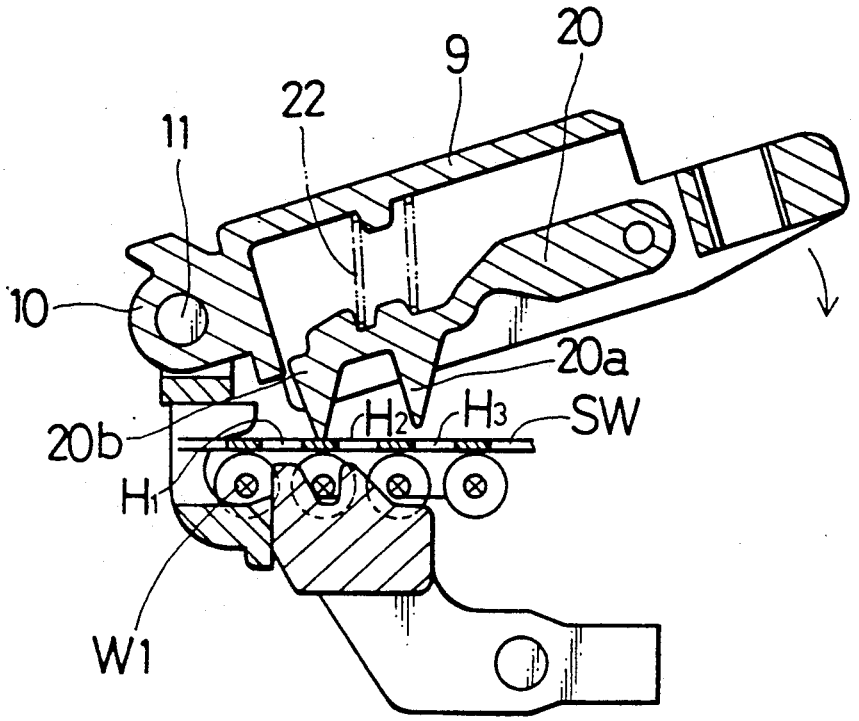
FIGS. 3 to 7 are views showing various operations of the nailing machine.
Figure 4:
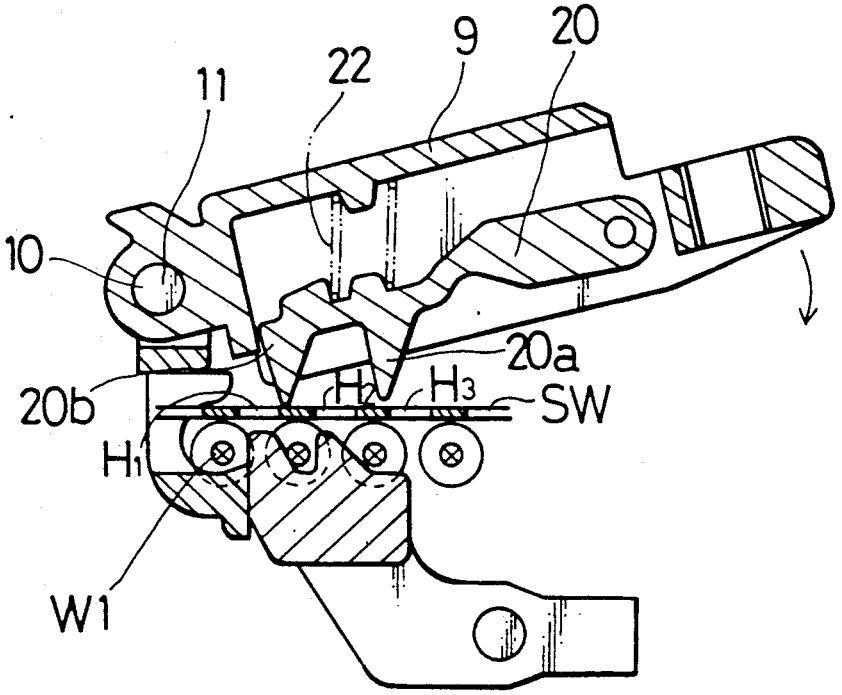

As described in connection with the prior art, the strip S of the nail-carrying strip SW tends to be floated when it is set into the nail feeding channel 12. In order to prevent such floating of the strip S, the strip-retaining pawl 20*b* of the engaging pawl member 20 abuts on the strip S as the door member 9 is closed as shown in FIG. 3. At this stage, the engaging pawl 20*b* does not reach the strip S, and the engaging pawl 20*b* may not engage a third engaging hole H3 counted from a first hole H1 positioned at the frontmost position (see FIG. 4).

Figure 5:
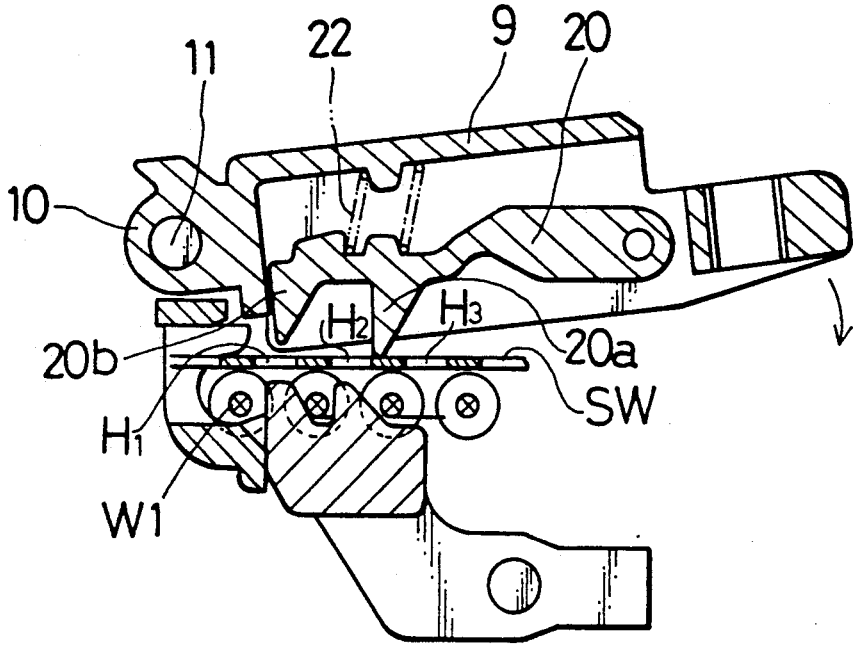

As the door member 9 is further closed, the engaging pawl 20*b* moves to a position adjacent a second engaging hole H2 while the strip-retaining pawl 20*b* is moved away from the strip S as shown in FIG. 5.

Figure 6:
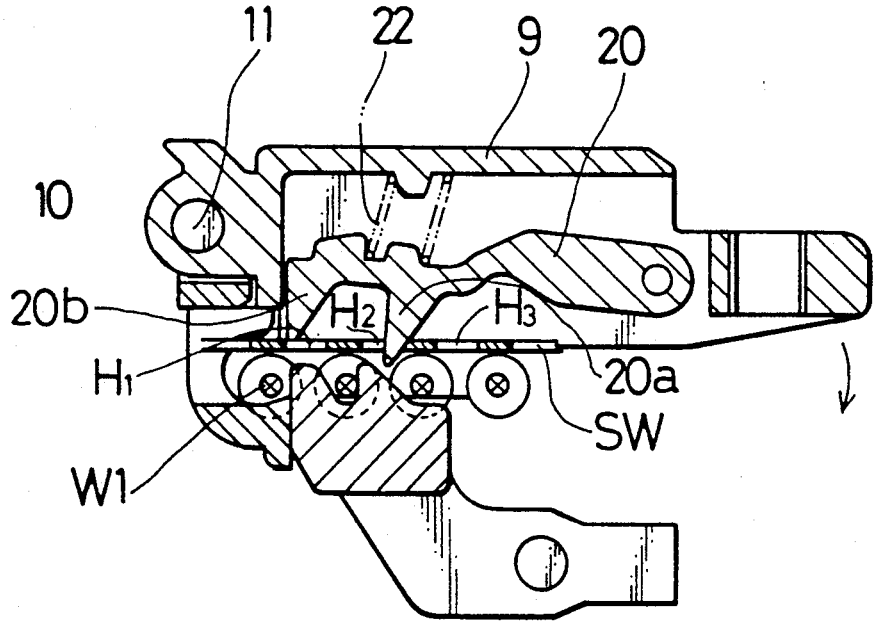

When the door member 9 is completely closed as shown in FIG. 6, the strip-retaining pawl 20*b* again abuts on the strip S while the engaging pawl 20*a* is in engagement with the second engaging hole H2.

Figure 7:
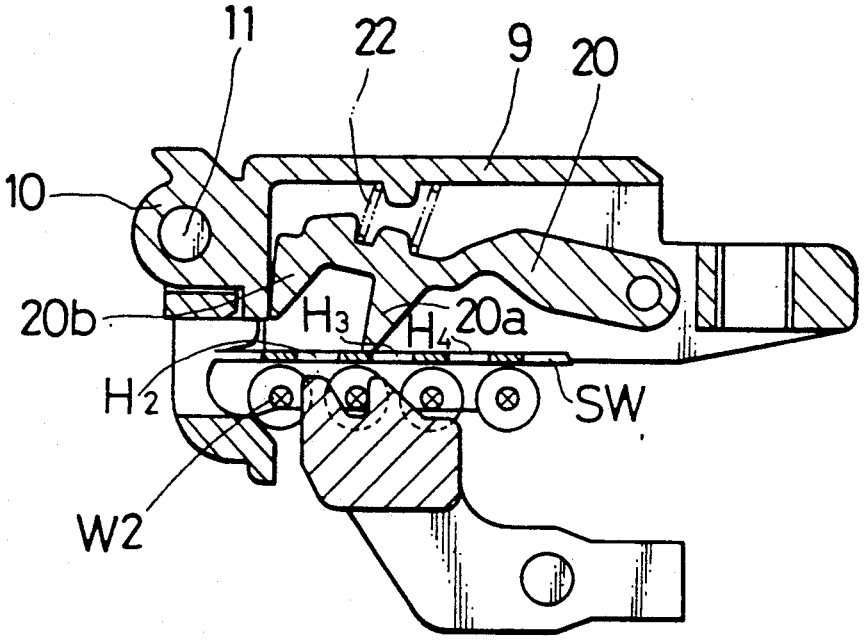

When the nail W2 is moved to be fed into the nail guide channel 4 after driving of the first nail W1, the engaging pawl 20*a* is disengaged from the second engaging hole H2 as shown in FIG. 7.

As described above, with the nailing machine 1 of this embodiment, through abutment of the strip-retaining pawl 20*b*, the strip S is prevented from being floated when the door member 9 is closed after setting of the nail-carrying strip SW. Therefore, the door member 9 can be closed without accompanying any problems. Further troubles such as jamming of the nails W within the nail guide channel 4 can be prevented.

While the invention has been described with reference to a preferred embodiment, it is to be understood that modifications or variation may be easily made without departing from the spirit of this invention which is defined by the appended claims.

What is claimed is:

1. A nailing machine comprising:

a body;

a driver guide mounted on said body and having therein a nail guide channel through which a driver for driving nails is reciprocally driven;

a nail feeding channel member having therein a nail feeding channel connected to said nail guide channel for feeding a nail-carrying strip stored in a magazine to said nail guide channel, the nail-carrying strip including strip and a plurality of nails carried thereon by a predetermined pitch, the strip having a plurality of engaging holes spaced from each other by the same pitch as the nails;

nail feeding means for feeding the nail-carrying strip into said nail guide channel;

a door member mounted on said nail feeding channel member for closing and opening said nail feeding channel; and an engaging pawl and a strip-retaining pawl mounted on said door member:

said engaging pawl being operable to engage one of said engaging holes of the nail-carrying strip set in said nail feeding channel, as said door member is closed, for preventing movement of the nail-carrying strip in a direction opposite to the feeding direction of the nail-carrying strip; and said strip-retaining pawl being operable to abut en the nail-carrying strip prior to engagement of said engaging pawl with said one engaging hole, as said door member is closed, for preventing floating of the nail-carrying strip.

2. The nailing machine as defined in claim i wherein said door member includes an arm mounted on said door member pivotaly around a first pivotal axis; and said arm includes said engaging pawl and said strip-retaining pawl.

3. The nailing machine as defined in claim 2 and further including biasing means for normally biasing said arm in a direction such that said engaging pawl and said strip-retaining pawl are moved toward the nail-carrying strip.

4. The nailing machine as defined in claim 3 wherein said door member is pivotaly mounted on said nail feeding channel member around a second pivotal axis adjacent said driver guide; said first pivotal axis extends in parallel with said second pivotal axis and is positioned rearwardly of said second pivotal axis; and said arm extends forwardly toward said second pivotal axis and has said engaging pawl and said strip-retaining pawl at its forward end.

5. The nailing machine as defined in claim 4 wherein said strip-retaining pawl is positioned forwardly of said engaging pawl and adjacent said second pivotal axis of said door member.

6. The nailing machine as defined in claim 1 wherein said strip-retaining pawl has a width longer than the width of the engaging holes of the nail-carrying strip, so as not to engage the engaging holes when said strip-retaining pawl abuts on the nail-carrying strip.

* * * * *